US005479680A

United States Patent [19]

Stalder et al.

[11] Patent Number: 5,479,680

[45] Date of Patent: Jan. 2, 1996

[54] SLIVER DRAFTING APPARATUS

[76] Inventors: Herbert Stalder, vord.Bantalstrasse 9, CH-8483 Kollbrun; Peter Toggweiler, Hulfteggstr. 4, CH-8400 Winterthur, both of Switzerland

[21] Appl. No.: 10,265

[22] Filed: Jan. 28, 1993

Related U.S. Application Data

[63] Continuation-in-part of Ser. No. 681,047, Apr. 5, 1991, abandoned.

[30] Foreign Application Priority Data

Apr. 6, 1990 [CH] Switzerland ..... 01175/90

[51] Int. Cl.[6] ..... D01H 5/86

[52] U.S. Cl. ..... 19/248; 19/252

[58] Field of Search ..... 19/236, 244, 248, 19/249, 250, 252, 251, 253, 254, 255

[56] References Cited

U.S. PATENT DOCUMENTS 3,126,585 3/1964 Tabor et al. ..... 19/244
4,520,532 6/1985 Stalder et al. ..... 19/244
4,553,290 11/1985 Kato ..... 19/244
4,644,609 2/1987 Lattner ..... 19/244
4,656,695 4/1987 Lattner ..... 19/236

*Primary Examiner*—C. D. Crowder
*Assistant Examiner*—Michael A. Neas

[57] ABSTRACT

A drafting apparatus for drafting a sliver in the yarn spinning machine preferably comprises upper and lower inlet rollers (2, 3), upper and lower apron belts (9, 6), upper and lower apron belt guides (10, 7) and upper and lower outlet rollers (4, 5). The upper apron belt (9) passes around the upper inlet roller (3) and the upper apron belt guide (10) and the lower apron belt (6) passes around the lower inlet roller and the lower apron belt guide (7) and cooperates with the upper apron belt (9) to define a nipping area (22) between the belts for nipping the fiber sliver (20) as it passes between the upper and lower inlet rollers while being sandwiched between the upper and lower apron belts (9, 6). The sliver is nipped in the nipping area (22) and is subsequently directed by the belts to a nip (25) formed between the upper and lower outlet rollers. The arrangement is such that the sliver is caused to move around a generally S-shaped path and is preferably trapped over the majority of the movement along this path between the two belts. This results in excellent guidance of the fiber and high uniformity of the spun yarn.

51 Claims, 2 Drawing Sheets

SLIVER DRAFTING APPARATUS

The present application is a continuation in part of U.S. application Ser. No. 07/681,047 filed Apr. 5, 1991 for DRAFTING ARRANGEMENT WITH AT LEAST ONE APRON DRAFTING ZONE which is entitled to priority of Swiss Application No. 01 175/90-3 filed Apr. 6, 1990.

BACKGROUND OF THE INVENTION

The present invention relates to sliver drafting arrangements used in spinning machines, and in particular to a drafting apparatus having at least one apron drafting zone.

The drafting arrangements for drawing a sliver of parallel fibers are well known in the yarn spinning art. Typical drafting arrangements comprise a series of pairs of rollers of sequentially increasing circumferential roller speeds, the last pair of rollers acting as a pair of sliver delivery rollers to ultimately deliver the drafted sliver to a mechanism for spinning sliver into a yarn, such as a ring spinning or air jet spinning apparatus.

Drafting arrangements utilizing an apron pair, i.e. a pair of apron belts for additional guidance of the drafted sliver are known from, for example, German Auslegeschrift 11 15 160. There, a tensioning device is described for use in conjunction with an upper apron belt of an apron drafting arrangement in a cradle guided with a rigid diverting rail. The bent diverting rail tensions the upper apron by means of a resiliently supporting tension member and is thereby pressed against a fixed stop by an adjusting screw. A nipping area is formed in this apron drafting mechanism between the two aprons. In practice it is difficult with an arrangement in accordance with German Auslegeschrift 11 15 160 to exert a uniform pressure within the apron belts on a sliver to be drawn by the drafting arrangement. More particularly, the pressure between the pair of rollers of the apron drafting arrangement is considered to be greater than the pressure on the cradle or spring loaded arm. As a result, irregular guidance of the fibers in the drafting zone may result which is particularly undesirable for spinning from a twist-free parallel-laid fiber sliver.

As is known in the art, drafting arrangements are typically configured such that the nip lines or areas of each of the pairs of rollers or aprons which comprise the drafting apparatus are arranged in a common plane, in approximately a common plane, or at least in some orientation such that the sliver of fibers being transported through the nip line or area of one set of rollers or apron belts is ultimately delivered into the nip line or area of an immediately following set of rollers or apron belts.

Depending on the exact configuration of the spinning machine, servicing robot, auxiliary mechanisms or other factors involved in a particular spinning apparatus or process, the path of sliver delivery through a drafting apparatus may be arranged such that the sliver emerging from the nip area of a set of rollers or aprons is directed initially along a path of emergence into direct contact with one of a pair of immediately following rollers, whereby the sliver is ultimately routed into the nip of the immediately following rollers.

In one arrangement of this kind (U.S. Pat. No. 4,520,532 Stalder et al.) respective upper and lower guides are provided for the upper and lower apron belts, with the belts being deflected around nose regions of the respective guides adjacent to the upper and lower outlet rollers. This arrangement is particularly contrived so that one of the nose regions projects into the converging space between the inlet and outlet rollers in the direction towards the nip and guides the sliver as closely as possible up to the nip. Moreover, the arrangement is contrived such that, in a beneficial manner, the sliver is deflected over a curved surface of the projecting nose region prior to entry into the nip and also such that the upper and lower apron belts extend closely up to the inlet and outlet rollers. These features are considered beneficial because the deflection of the sliver around the curved nose region of the one apron guide prior to entering into the nip provides additional guidance of the fibers and because the apron belts extending closely up to the inlet and outlet rollers prevent substantial quantities of air being drawn into the nip by the rollers at high speeds of rotation which otherwise causes undesirable disturbance of the fiber sliver. More specifically, if these air streams were not inhibited in some way, they would converge adjacent to the nip and, because of the converging space, would be forced to flow in an axial direction to escape around the sides of the rollers. In so doing they would tend to spread any fiber sliver that may be there and to substantially disturb the orientation of the fibers in the sliver. Despite the beneficial guidance immediately prior to the inlet and outlet rollers provided by the arrangement of U.S. Patent 4,520,532, problems can arise with the guidance of the sliver on its path while sandwiched between the upper and lower apron belts from the upper and lower inlet rollers to the upper and lower outlet rollers. It is noted that this path is essentially a straight path apart from the slight deflection around the nose region of the lower apron guide. Thus, this arrangement, while providing substantial improvements over previous arrangements is still associated with certain guidance problems.

A not dissimilar arrangement is shown in the later U.S. Pat. No. 4,644,609 (Lattner). This reference is not particularly concerned with the guidance of a fiber sliver in a drafting mechanism between two apron belts but rather with the ability to automatically stop and restart the drafting mechanism following strand breakage and repair. This U.S. patent however also shows an arrangement in which the upper and lower apron belts run over upper and lower guide members with the lower guide member being slightly curved and the upper guide member having essentially only a nose region which exerts a guiding function on the upper apron belt as the latter passes around the nose adjacent to the upper outlet roller. The lower guide member with a convexly curved guide surface has a depression or step following the curved guide surface which then merges into a nose portion adjacent the lower outlet roller around which the lower apron belt is deflected. The arrangement is such that neither the upper apron belt nor the lower apron belt is pressed into the depression in the surface of the lower guide member between the convexly curved portion and the nose region. It is essentially only the tension in the upper apron belt which presses the upper apron belt against the curved run of the lower apron belt as it moves around the lower guide member. In practice limits are set on the tension which can be inserted on the upper apron belt, not least because of the need to move the upper apron belt in a sliding movement around the relatively sharply rounded nose region of the upper apron belt guide. Accordingly restrictions are placed on the guiding of the sliver as it passes to the outlet roller pair from the nipping area between the inlet roller pair, and problems can arise with respect to the uniformity of the sliver entering the outlet roller pair and with respect to the uniformity of the subsequently spun yarn. Another arrangement with a lower apron belt guide having a convexly curved surface and an upper apron belt guide defining a nose around which the upper apron belt is deflected immediately in front of the upper outlet roller is disclosed in East German Patent 292,940. If a tangent is drawn to the surface of the lower apron belt immediately before it passes around the front nose region of the lower apron belt guide, i.e. at the point of separation of the sliver from the lower apron belt, then this tangent projects through the nip of the upper and lower outlet rollers and this is indeed the path followed by the fiber sliver. The same is effectively true of the arrangement of the above mentioned U.S. Pat. No. 4,644,609, i.e. the sliver is not subjected to a deflection as it leaves the lower apron belt prior to entry into the nip between the upper and lower outlet rollers. The arrangement of DD 292 940 rather still does not result in a fully satisfactory guidance of the sliver between the apron belts and as it passes into the nip between the upper and lower outlet rollers.

It should also be pointed out that the lack of guidance becomes more critical as the speed of the fiber sliver and the drafting ratio increases.

Finally, for the sake of completeness reference should be made to U.S. Pat. No. 4,533,290 which also discloses an apron belt drafting mechanism rather similar to that disclosed in U.S. Pat. No. 4,520,532 to Kato but with the sliver also moving in a straight line without deflection from the inlet roller pair to the outlet pair while being sandwiched between the apron belts. With such arrangements with the belts moving in a straight line it is difficult to obtain a uniform pressure on the sliver sandwiched therebetween. The special point of the Kato patent is the provision of an apron belt with a long working life.

OBJECTS OF THE INVENTION

It is therefore an object of the invention to provide a drafting arrangement of the type generally mentioned above which provides more precise guidance of the fibers of the sliver between the two aprons. A further object of the invention is to provide a drafting arrangement which is particularly suitable for so-called sliver spinning. It is a still further object of the present invention to provide a drafting arrangement which results in more uniform properties of the spun yarn formed from the drafted sliver.

SUMMARY OF THE INVENTION

In accordance with the invention therefore, there is provided a drafting apparatus having an apron zone for drafting a sliver in a yarn spinning machine comprising:

at least one apron drafting mechanism comprising a pair of upper and lower inlet rollers forming a rearward apron nipping area, an upper apron and a lower apron, a spring loaded upper apron cradle mechanism having a forward nose for engaging the upper apron, a guide having an upper surface and a forward nose for engaging the lower apron and a pair of upper and lower sliver delivery rollers;

wherein the upper apron travels around the upper inlet roller and around the forward nose of the cradle mechanism, and wherein the lower apron travels around the lower inlet roller and around the forward nose of the guide;

the guide having at least one step-like recess in its upper surface upwardly facing the lower apron, the step-like recess having a rearward edge and the spring loaded cradle mechanism urging the upper apron downwardly into pressing engagement with said lower apron, with the sliver being subjected to a substantial angular deflection while pressed between the aprons as it moves around a portion of said guide, and being subjected to a further oppositely directed deflection as it moves around one of the forward nose of the cradle mechanism and the forward nose of the stepped guide.

As used herein the term "sliver" is intended to mean any sort of strand of fibers in a reasonably coherent strand form and is not limited to a strand of any particular width or thickness or comprising fibers of any particular kind, composition, quality, length, width, fineness, strength, stiffness, elongation or the like.

The effect of this arrangement is to subject the fiber sliver to at least two discrete deflections as it passes between the inlet roller pair and the outlet roller pair. At least one of these deflections takes place while the sliver is sandwiched between the upper and lower apron belts and the fiber sliver is turned at this point of deflection through a relatively large angle, for example in the range 20° to 40° and particularly of about 30° over a relatively short distance. During this the tension present in the lower belt which is concavely deflected exerts a fairly high contact pressure force on the fibers of the fiber sliver passing between the two belts. This contact pressure ensures that the fiber sliver is stably held and thus well guided but is generally not sufficient to generate another nipping area, since this would be undesirable and indeed could lead to fiber breakages if the deflection area is closer to the nip of the outlet roller pair than the staple length of the fibers of the sliver. Nipping should only preferably occur between the apron belts as they pass around the roller pair of the apron mechanism where a first nipping area is defined and as the sliver passes between the outlet roller pair where a nip is defined. Since the outlet roller pair runs faster than the inlet roller pair the fiber is drawn out, i.e. drafted between the two roller pairs. It will be appreciated that the guiding forces or pressure forces generated as the fiber is deflected around the deflection between two belts must be sufficient to keep the fiber sliver together but not so great that they inhibit a mutual sliding of the fibers relative to one another in the direction of movement of the sliver which is necessary for successful drafting.

The first basic concept of the invention can be realized in at least two different ways. In one way the drafting apparatus is desired so that the forward nose of the cradle mechanism extends forwardly beyond the forward nose of the guide, the spring loaded cradle mechanism urging the upper apron downwardly over the forward nose of the guide such that the first substantial angular deflection takes place in one direction over the forward nose of the guide and the second angular deflection takes place in an opposite direction around the forward nose of the cradle mechanism.

In the second way the drafting apparatus is designed so that said forward nose of said guide extends forwardly beyond said forward nose of said cradle mechanism, the spring loaded cradle mechanism urging the upper apron extending around the forward nose of the cradle mechanism into the recess of the guide, the first substantial angular deflection taking place around the forward nose of the cradle mechanism within the recess and the second angular deflection taking place in an opposite direction over the forward nose of the guide. There are now two points at which the fiber sliver is deflected while being trapped between two apron belts. It is important that the fibers of the sliver are subjected to a high level of guidance at the point of points of deflection at a position fairly close to the outlet rollers of the drafting mechanism. This results in precise and high quality fiber guidance. The apron drafting arrangement in accordance with the invention does not contemplate having a stop between the cradle for the upper apron and the guide element for the lower apron, although this is also not precluded. A preferred drafting apparatus in accordance with the invention for drafting a sliver in a yarn spinning machine comprises upper and lower apron inlet rollers, upper and lower apron belts, upper and lower apron belt guides, and upper and lower outlet rollers, wherein the upper apron belt passes around the upper inlet roller and the upper apron belt guide and the lower apron belt passes around the lower inlet roller and the lower apron belt guide and cooperates with the upper apron belt to define a nipping area between the belts for nipping the fiber sliver as it passes between the upper and lower inlet rollers while being sandwiched between the upper and lower apron belts, the sliver being nipped in the nipping area and being subsequently directed by the belts to a nip formed between the upper and lower outlet rollers, and wherein a nose region of one of the upper and lower apron belt guides around which the respective apron belt is deflected extends closer up to the inlet and outlet rollers than the other nose region of the other one of the upper and lower apron belt guides around which the other respective apron belt is deflected, wherein the upper and lower apron belt guides have curved apron belt engaging surfaces over at least substantially their full length sliding contact is made with the respective apron belts as they pass from the upper and lower inlet rollers towards the nose regions of the guide surfaces, and wherein the upper and lower apron belt guides cooperate to define a generally S-shaped path for the sliver between the nipping area of the apron mechanism to the upper and lower outlet rollers, with both of the apron belts lying substantially parallel to one another over at least a major portion of the S-shaped path.

With this arrangement the fiber sliver is effectively continuously guided on a curved path between the inlet apron roller pair and the outlet roller pair and again undergoes at least one deflection and preferably two deflections while sandwiched between the upper and lower apron belts.

Thus in this arrangement it is ensured that the apron belts continuously move over a curved path as they pass from the upper and lower inlet rollers towards the nip of the outlet rollers. Thus areas of straight line movement of the two apron belts are avoided. It will be appreciated that in such areas of straight line movement the tension in the belts effectively precludes a substantial pressing force acting normal to the direction of movement of the sliver over the full length of the belt/sliver/belt sandwich which is equivalent to saying that the guidance of the sliver in such regions is not fully adequate.

In a preferred embodiment of the invention, a generally S-shaped path for said sliver is realized in a drafting apparatus wherein the lower guide has a convexly curved surface extending up to its nose region and forming a first portion of said S-shaped path around which said lower apron belt is guided and wherein said upper guide has a convexly curved surface extending up to its nose region defining a second portion of the S-shaped path around which the upper apron belt passes with the first and second portions of the S-shaped path merging into each other via a smooth tangential transition, and wherein the nose region of the upper apron belt guide extends furthest towards the nip formed between the upper and lower outlet rollers.

Because the nose region of the upper apron belt guide extends into the convergent space between the inlet and outlet rollers it is possible to move the apron belt close up to the surface of the lower outlet roller an thus to use it to prevent substantial airflows being carried with said upper roller into the nip and disturbing the fibers of the sliver passing around the end of the nose region. Moreover, the nose region of the upper apron guide can be positioned so that the sliver is deflected around it and indeed through a relatively substantial angle of between 10 and 30 and preferable about 20°. The deflection tends to press the sliver against the curved surface of the upper apron belt as it moves around the upper apron belt guide and this improves the guidance of the sliver.

In an alternative, preferred embodiment a drafting apparatus is provided wherein the lower guide has a curved generally S-shaped guide surface for the lower apron belt, the S-shaped guide surface extending substantially up to the nose region the lower guide and wherein the upper guide has a convexly curved guide surface extending up to its nose region, with the convexly curved guide surface of the upper apron belt guide being disposed adjacent to and conforming in shape to the curve of the S-shaped surface of said lower guide adjacent said upper and lower outlet rollers. Here the S-shaped path of the sliver is determined by the S-shaped surface of the lower guide and the sliver is subjected to two substantial angular deflections into opposite directions as it moves along the S-shaped surface of the guide while sandwiched between the two apron belts.

BRIEF DESCRIPTION OF THE DRAWINGS

Further advantages of the invention are evident from the following description, the invention being explained in detail by reference to the drawings of an exemplary embodiment wherein.

DETAILED DESCRIPTION OF THE PREFERRED EMBODIMENTS

Figure 1:
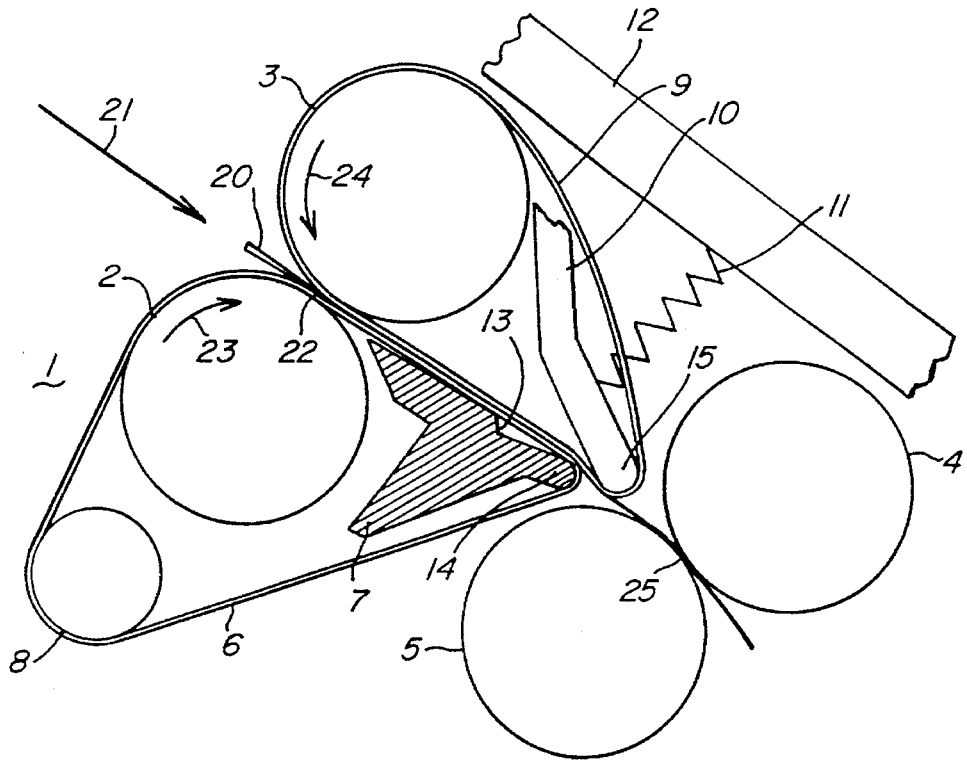
FIG. 1 is a schematic side cross-sectional view showing a first position of an upper apron cradle in an apron drafting apparatus.
Figure 2:
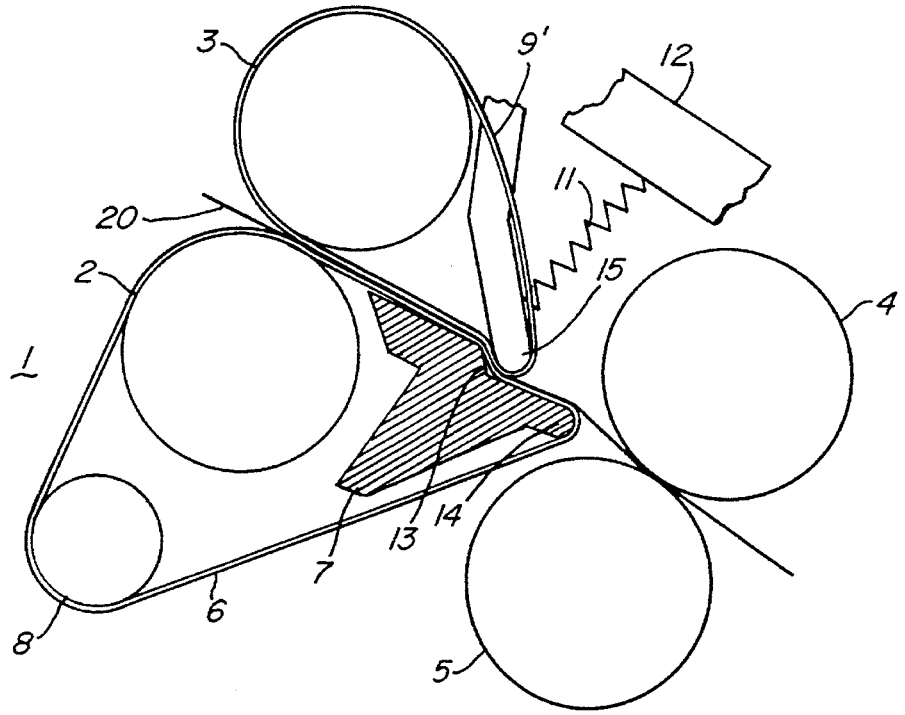
FIG. 2 is a schematic side cross-sectional view showing a second position of the upper apron cradle of the FIG. 1 apparatus.

The same reference symbols are used in FIGS. 1 and 2 to denote analogous elements. Generally, a sliver 20 comprising an aggregation of individual fibers having a predetermined mean staple fiber length is fed from a source of sliver storage into a first set of fiber feed rollers (not shown) of a drafting apparatus. The sliver 20 delivered out of the nip of the feed rollers may be ultimately delivered into for example, the nipping area formed between apron rollers 2, 3 by a pair of aprons or apron belts such as 6, 9, FIGS. 1, 2.

FIG. 1 shows an apron drafting zone 1 comprising apron inlet rollers 2 and 3 which form a first nipping area or line 22 and deliver a fiber sliver 20 to a pair of outlet or delivery rollers 4 and 5. A lower apron 6 is driven over or around a lower roller 2 and is guided around an apron guide roller 8 and a guide element or lower apron belt guide 7 directed towards the outlet or delivery rollers 4, 5. The guide 7 is mounted in a conventional manner underneath, i.e. inside, the apron belt 6 which travels over an upper surface of guide mechanism 7. As shown in FIGS. 1, 2, the upper surface of the guide 7 extends from back to front relative to the direction of travel 21 of the sliver 20 and terminates at its forwardmost edge 14 in a curved or rounded edge or nose region 14. A recess 13 is formed by a step in the upper surface of the guide 7 intermediate the back and front edges of the guide 7.

An upper apron or apron belt 9 is guided over or around the upper roller 3 and around an apron cradle or apron belt guide 15 in the form of a downwardly biased spring loaded arm 10 represented in FIGS. 1, 2 in partial form. The cradle 10 is mounted in a conventional manner above the apron belt 9 and terminates at its forwardmost end in a curved or rounded nose region 15 around which apron 9 travels. One or both of rollers 2, 3 are driven in the direction shown by the arrows 23, 24 to drive the aprons 6, 9, of FIGS. 1, 2, in the same directions around the various elements 3, 10 and 2, 7, 8 such that the sliver 20 is driven by engagement between the aprons in the direction 21. The cradle 10, which may be thought of as two arms extending on either side of the upper apron belt and connected together in the nose region 15 by a bar element, is urged against the guide element 7 by means of a spring 11 which is opposingly engaged against a stationary frame portion 12 of a spinning machine. The step or recess 13 in the guide 7 is disposed in a contact zone between the two aprons 6 and 9 and the forward edge 14 is disposed towards the pair of outlet or delivery rollers 4, 5. The end 15 of the upper apron cradle 10 is shown arranged in one position, FIG. 1, to project forwardly beyond the edge 14 of the guide element 7, so that a forward apron deflecting area is formed on the top of edge 14 forwardly adjacent to the nip line or nip area 25 between the apron rollers 4, 5 and the nipping area on the top of edge 14 is selected such that it is smaller or at most equal to the mean staple fiber length of the fiber being processed within sliver 20. The nose region 15 of the cradle 10 and the nose region 14 are both rounded or curved such that excessive friction is avoided with the aprons 6 and 9 traveling over or around the rounded noses 14, 15.

In FIG. 2, a similar apron draft zone 1 is shown where the nose region 15 of the upper apron belt guide 10 is pressed within the stepped recess within the upper surface 13 of the lower apron belt guide element 7. The upper apron 9' is shorter than the upper apron 9 in FIG. 1 for this purpose.

In this embodiment shown in FIG. 1 the step 13 enables a certain relaxation of the lower apron 6 in the area of the guide element 7. As a result, the forward sliver guiding area between aprons 6, 9 in the area above edge 14 is exactly defined. In the alternative embodiment shown in FIG. 2, the forward sliver guiding area is located between the aprons 6, 9' in the region above step 13. Both embodiments ensure a more precise fiber sliver guidance between the beginning and end of the apron zone 1. As can be seen from FIGS. 1, 2 the disposition of the recess 13 in the upper surface of the guide mechanism 7 controls the conformation of the forward sliver guiding area and the direction in which the sliver 20 is guided upon emergence from the forward sliver guidance area. As shown in FIG. 1 embodiment the fiber sliver 20 is directed upon emergence from the forward sliver guiding area directly into contact with the lower delivery roller 5 whereas in the embodiment according to FIG. 2, the sliver is directed upon emergence from the forward sliver guiding area directly into contact with the upper roller 4. Initial contact of the emerging sliver 20 with one of the other rollers 4, 5 results in an additional guidance of the sliver 20 through a kind of embracing of the surface of roller 4 or 5 an ultimate guidance into the nip of rollers 4, 5. The nose 15 of the upper apron cradle 10, is for this purpose, disposed as closely adjacent as possible to the lower roller in the FIG. 1 embodiment or, alternatively, the nose 14 is disposed as closely adjacent as possible to the upper roller 4 in the FIG. 2 embodiment of the pair of drafting arrangement delivery rollers. Typically this close adjacency of nose 14 or 15 to rollers 4 or 5 is less than about 5 mm, typically less than 1–2 mm. Both embodiments may be employed as advantageous apron apparati in conventional drafting arrangements used to draft, guide and deliver a sliver to a spinning mechanism and are particularly useful in conjunction with ring spinning machines which spin directly from a twist free fiber sliver. The above described drafting arrangement is similarly suitable for use in conjunction with air jet spinning apparati.

Figure 3:
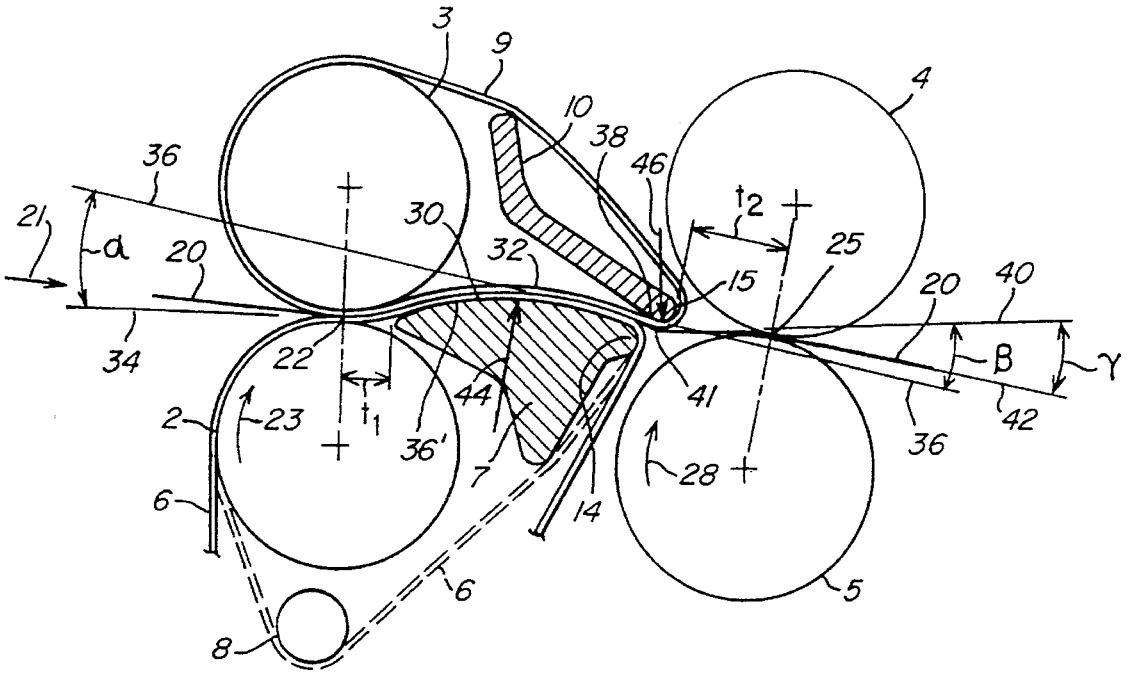
FIG. 3 is a schematic side cross-sectional view of an alternative embodiment of a drafting apparatus with an extended S-shaped path of movement of the sliver.
Figure 4:
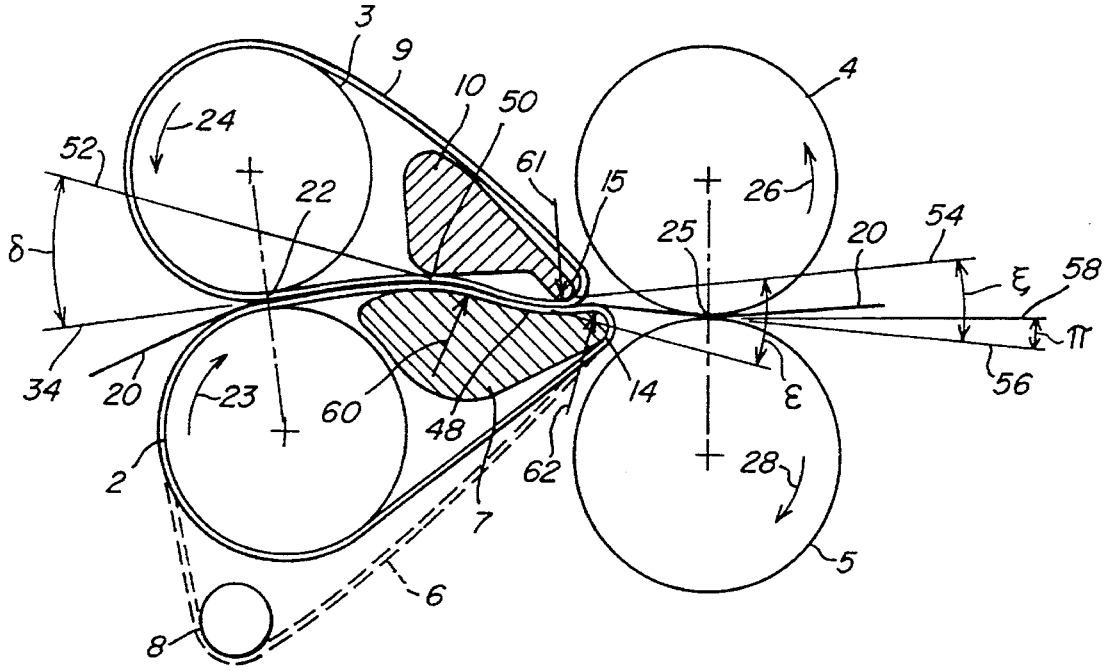
FIG. 4 is a schematic side cross-sectional view of a further alternative embodiment of a drafting apparatus also having an S-shaped path of movement of the sliver, less extended than the S-shaped path in the FIG. 3 apparatus.

FIGS. 3 and 4 now show particularly preferred embodiments of the invention which in some respects resemble FIGS. 1 and 2 but otherwise have several differences which are however extremely important in obtaining superior drafting performance. Because of the close mechanical similarity, components in FIGS. 3 and 4 which have counterparts in FIGS. 1 and 2 have all been labelled with the same reference numerals. Moreover, although not shown, the rollers are mounted in the customary manner in the drafting mechanism, as indeed is also case with the arrangements of FIGS. 1 and 2.

Moreover, in operation, the arrangements of FIGS. 3 and 4 are driven in the same manner as the arrangements of FIGS. 1 and 2. That is to say the lower input roller 2 is driven in the direction of the arrow 23 and the lower outlet roller 5 is driven in the direction of the arrow 28 and indeed with a faster surface speed than the surface speed of the roller 23, which is necessary to achieve the desired drafting action. The lower inlet roller 2 drives the apron belt 6 and the apron belt 6 drives the apron belt 9 by friction. The upper inlet roller 3 is merely allowed to idle. In the same manner the lower output roller 5 drives the upper output roller 4 via frictional contact therewith.

The important differences between the FIG. 3 and FIG. 1 embodiments are to be found primarily in the area of the lower apron belt guide 7 and the different path which results for the apron belts 6 and 9 with the sliver 20 sandwiched between them as a result of this shape. More specifically the lower guide 7 has a convexly curved guide surface 30 which deflects the lower apron belt 6 into a corresponding convexly curved shape as it moves over the curved guide surface. Because of the tension in the lower apron belt 6 it closely follows the curved shape of the convexly curved guide surface 30 as it moves over it and as it moves around the curved surface 30, but without a step. The lower run 32 of the upper apron belt 9 moves parallel to the convexly curved upper run 36' of the lower apron belt 6 as the two belts move together over the convexly curved guide surface 30.

The sliver 20 is squeezed gently between the upper run 36' of the lower apron belt 6 and the lower run 32 of the apron belt 9 as these two runs move together over the surface 30 with the sliver sandwiched between them. The tension in the apron drive belt 9 gives rise to the requisite pressure between the two apron drive belts as they move together over the curved guide surface 30.

As the lower apron belt 6 moves around the nose region 14 it separates from the sliver which still lies on the upper apron belt 9 while the latter starts to move around the nose region 15 of the upper belt guide 10. The sliver is being drawn by the output rollers 4 and 5 as it passes through the nip Thereof and is thus deflected in the opposite direction to the deflection which occurs on the convexly curved surface 30 as it moves around the nose region 15 immediately prior to entering into the nip 25. This means that the sliver follows a generally S-shaped path from the nipping area 22 of the upper and lower inlet rollers 2, 3 to the nip 25 between the upper and lower outlet rollers 4, 5. It will be seen that this S-shaped path extends over practically the full distance between the two nips or nipping areas 22, 25. Moreover it will be noted that the upper apron belt 9 less fairly close to the output roller 4 and to the output roller 5 thus considerably reducing the effects of air movements caused by air transported with the rollers 4, Thus it will be noted from the drawing that the angle formed between a first tangent 34 to the upper and lower inlet rollers in the nipping area 22 and the tangent 36 to the convexly curved surface 30 of the lower guide 7 at a transition point 38 of the fiber sliver 20 from the convexly curved surface of the lower guide 7 to the convexly curved upper surface of the upper guide 10 amounts to an angle of almost 40°. In practice this angle $\alpha$ can lie in the range from 20° to 50°, 40° being a preferred value. Moreover FIG. 3 also shows that the angle $\beta$ between the tangent 36 and a further tangent 40 to the curved surface of the upper guide at the nose region 15 at the point 42 of separation of the sliver from the curved surface of this upper guide 10 amounts to an angle of approximately 20°. More particularly the angle $\beta$ can now be in the range from 10° to 30° with 20° representing a preferred value.

FIG. 3 also shows an angle $\gamma$ between the tangent 40 and a tangent 42 to the upper inlet and outlet rollers 4 and 5 at the nip 25. The angle $\gamma$ preferably amounts to 10° but can conveniently lie in the range from 5° to 15°.

In addition the drawing of FIG. 3 indicates the radius 44 of curvature of the convexly curved guide surface 30 of the lower apron guide 7. This radius 44 preferably amounts to 25 mm but optionally lies in the range 15 to 50 mm. Moreover, the drawing also shows the preferred radius 46 of the nose region of the upper apron belt guide 10. This radius 40 preferably amounts to 3 mm but optionally lies in the range from 2 to 5 mm.

The arrangement of FIG. 4 is similar but here the lower apron guide 7 has an S-shaped guide surface 48 with the upper guide having a convexly curved guide surface 50 extending up to its nose region 15, with the convexly curved guide surface 50 of the upper apron belt guide being disposed adjacent to and conforming in shape to the curve of the S-shaped surface of the lower guide 7 adjacent upper and lower outlet rollers. The curved guide surface 50 of the upper guide 10 as it were nestless into the concavely upwardly facing half loop of the S-shaped guide surface 48 and extends generally parallel thereto. In this way the lower run of the upper apron belt 9 and the upper run of the lower apron belt 6 move parallel to one another over the S-shaped surface 48 with the sliver 20 sandwiched therebetween. The sliver 20 thus executes two sequential deflections while being guided between the two belt runs, and is indeed guided over a curved path over substantially the full distance from the nipping area 22 of the inlet guide rollers 2, 3 to the nip or nipping area 25 of the outlet guide rollers 4, 5.

It is noted that the fiber sliver, after separating from the upper apron belt 9 at the nose region 15 of the upper apron belt guide 10 then undergoes a further deflection around the nose region 14 of the lower apron belt guide 7 before moving into the nip 25 between the upper and lower outlet rollers 4, 5.

In the embodiment of FIG. 4 an angle 6 is formed between a tangent 34 to the upper and lower inlet rollers 3, 2 at the nipping area 22 and a tangent 52 to the S-shaped guide surface 48 of the lower apron belt guide 7 at a transition point where the sliver 20 starts to be guided around the convexly curved surface 50 of the upper apron belt guide 10. In a preferred embodiment this angle $\delta$ amounts to 30°, it can however lie in the range from 15° to 40°.

FIG. 4 also shows an angle e between the tangent 52 and a tangent 54 to the curved surface of the upper guide 10 at a point of separation of the fiber sliver therefrom at the nose region 15 adjacent to the nip 25 between the upper and lower outlet roller pair 4, 5. This angle e preferably amounts to 15° and lies in the range from 5° to 20°.

The angle $\xi$ between the tangent 54 and the tangent 56 to the S-shaped curved guide surface of the lower guide at the nose region 14 at a point of separation of the sliver from the lower guide adjacent the nip 25 preferably amounts to 15° and can lie in the range of 5° to 20°. Finally the angle $\pi$ between the tangent 56 and a tangent 58 to the upper and lower outlet rollers 4, 5 at the nip 25 preferably amounts to 10°, but can lie in the range from 5° to 15°.

The radius 60 of the first curve of the S-shaped guide surface 48 at a position between the upper and lower inlet rollers 2, 3 and the point of transition to the second curved portion of the S-shaped guide surface 48 preferably amounts to 20 mm but can lie in the range from 30 to 40 mm. The convexly curved surface of the upper guide 10 usefully has a radius of curvature 61 at a position confronting the S-shaped guide surface of the lower guide 7 of about 3 mm, this radius can however lie in the range from 2 to 5 mm. Finally the radius 62 of the nose region 14 of the lower apron belt guide 7 at the point of separation of the sliver 20 from the lower guide 7 preferably amounts to 3 mm but can again lie in the range from 2 to 5 mm.

In the embodiment of FIG. 4 the apron belt 6 again preferably defines relatively narrow clearances with the upper and lower rollers 4, 5 of less than 2 mm.

Although not shown in FIGS. 3 and 4 resilient bias means similar to the spring 11 of FIG. 1 is usefully provided to bias the upper guide 10 towards the lower guide 7. In the embodiment of FIG. 3 the distance from the point at which the fiber sliver separates from the lower apron belt to the nip 25 preferably amounts to less than the staple length of the fibers of the fiber sliver. Usefully this distance amounts to less than 75% of the mean staple length.

In the arrangement of FIG. 4 the distance from the point at which the sliver 20 separates from the upper apron belt to the nip 25 also preferably amounts to less than the mean staple length of the fibers and in particular amounts to less than 75% of this mean staple length.

It should however be noted that it would also be possible for the distance from the nip to the point at which the sliver separates from the apron belt which guides it closest to the nip to be greater than the staple length of the fibers of the fiber sliver, since the individual fibers are guided in the sliver by frictional contact with other fibers.

In FIGS. 3 and 4 also it is important to guide the sliver as well as possible between the rollers 2, 3 and 4, 5, i.e. to keep the fiber flow as compact as possible which can only really be achieved when, as shown in FIGS. 3 and 4 the lower belt 6 and the upper belt 9 lie as close to one another as possible and thus keep the fibers together as they pass from the nip 22 to the nip 25. This is only really achieved in a fully satisfactory manner when the belts move on curved, and indeed preferably S-shaped paths.

Furthermore, it is important that the fiber sliver is controlled in the area after leaving the gap between the upper and lower belts until it enters into the rollers 4 and 5. This can best be done when the fiber sliver runs into the gap between the rollers 4 and 5 via a further deflection location. In this way the free length of the fiber sliver within which the holding together of the fibers is not assisted by guide surfaces is kept as small as possible. The principal difference between the embodiments of FIGS. 3 and 4 lies essentially in the fact that in FIG. 3 the fiber sliver is only deflected once before leaving the guide zone between the belts 6 and 9, while nevertheless following an S-shaped path because of the further deflection around the nose region 15 of the upper belt guide 10, while in FIG. 4 the sliver experiences two deflections while being guided between the two belts. It will be noted from FIG. 3 that the distances t1 and t2 after the first roller pair 2, 3 and in front of the second roller pair 4, 5 in which the fiber flow is not guided only amount to a small fraction of the total guided length of the fiber sliver between the two roller pairs. The total unguided length t1 and t2 should preferably not amount to any more than ¼ of the total length of the fiber flow as it moves between the nipping area 22 and the nip 25.

Finally it will be noted that the designations upper and lower as used in this specification, together with associated geometrical descriptions such as "on" or "over" all relate to the orientation of a drafting apparatus as seen in the accompanying drawings. In principle however the orientation of the drafting apparatus could be chosen at will, for example the drafting apparatus could be inverted so that the upper elements become the lower elements and vice versa, or it could be turned on its side. It will be appreciated that no restriction is intended and the terms "upper" and "lower" and the associated terms all refer to a drafting apparatus orientated as shown in the drawing, and the claims are to be interpreted accordingly.

We claim:

1. A drafting apparatus having an apron zone for drafting a sliver in a yarn spinning machine comprising:

at least one apron drafting mechanism comprising a pair of upper and lower inlet rollers forming a rearward apron nipping area, an upper apron and a lower apron, a spring loaded upper apron cradle mechanism having a forward nose for engaging the upper apron, a guide having an upper surface and a forward nose for engaging the lower apron and a pair of upper and lower sliver delivery rollers;

the upper apron traveling around the upper inlet roller and around said forward nose of said cradle mechanism, and the lower apron traveling around the lower inlet roller and around said forward nose of said guide;

said guide having at least one step-like recess in its upper surface upwardly facing the lower apron, said step-like recess having a rearward edge and said spring loaded cradle mechanism urging the upper apron downwardly into pressing engagement with said lower apron;

the pressingly engaged aprons forming a sliver path therebetween which is substantially S-shaped along a substantial length of the path between the inlet rollers and the delivery rollers.

2. The drafting apparatus of claim 1 wherein said forward nose of said cradle mechanism extends forwardly beyond said forward nose of said guide, said spring loaded cradle mechanism urging said upper apron downwardly over said forward nose of said guide such that said first substantial angular deflection takes place over said forward nose of said guide and said second angular deflection takes place around said forward nose of said cradle mechanism.

3. The drafting apparatus of claim 1 wherein said forward nose of said cradle mechanism extends forwardly beyond said forward nose of said guide, the spring loaded cradle mechanism urging the upper apron downwardly into engagement with the lower apron the sliver being directed over the nose of the cradle mechanism toward the lower delivery roller.

4. The drafting apparatus of claim 1 wherein said forward nose of said guide extends forwardly beyond said forward nose of said cradle mechanism, the spring loaded cradle mechanism urging the upper apron extending around said forward nose of said cradle mechanism into said recess of said guide, said first substantial angular deflection taking place around said forward nose of said cradle mechanism within said recess and said second angular deflection taking place over said forward nose of said guide.

5. The drafting apparatus of claim 4 wherein said sliver is directed over said forward nose of said guide toward the upper delivery roller.

6. The drafting apparatus of claim 1 wherein said guide is mounted under the lower apron and has an upper surface extending back to front over which the lower apron extends and is supported in contact with the lower apron, the recess being disposed in the upper surface intermediate its back to front extension.

7. The drafting apparatus of claim 1 wherein said forward nose of said guide and of said cradle mechanism are curved for readily enabling the aprons to slidably travel therearound.

8. The drafting apparatus of claim 1 wherein said forward nose of said cradle mechanism extends forwardly beyond said forward nose of said guide such that said forward nose of said cradle mechanism is disposed closely adjacent to the lower delivery roller preventing air from being drawn into the nip of the delivery rollers.

9. The drafting apparatus of claim 1 wherein said forward nose of said guide extends forwardly of said forward nose of said cradle mechanism such that said forward nose of said guide is disposed closely adjacent to the upper delivery roller preventing air from being drawn into the nip of the delivery rollers.

10. The drafting apparatus of claim 1 wherein the rearward apron nipping area and a position at which said first angular deflection of said sliver occurs are spaced apart by a distance less than or equal to a mean staple length of the sliver fibers.

11. In a drafting apparatus for drafting a sliver in a yarn spinning machine, said drafting apparatus comprising upper and lower inlet rollers, upper and lower apron belts, upper and lower apron belt guides, and upper and lower outlet rollers, wherein said upper apron belt passes around said upper inlet roller and said upper apron belt guide, and wherein said lower apron belt passes around said lower inlet roller-and said lower apron belt guide and cooperates with said upper apron belt to define an inlet nipping area between said belts for nipping the fiber sliver as it passes between said upper and lower inlet rollers while being sandwiched between said upper and lower apron belts, said sliver being nipped in said nipping area and being subsequently directed by said belts to a nip formed between said upper and lower outlet rollers, and wherein a nose region of one of said upper and lower apron belt guides, around which one of the apron belts is deflected extends closer up to the inlet and outlet rollers than the other nose region of the other one of said upper and lower apron belt guides, around which the other apron belt is deflected, the improvement wherein said upper and lower apron belt guides have curved apron belt engaging surfaces over at least substantially the full length of contact with the respective apron belts as the belts pass from said upper and lower inlet rollers towards said nose region, and wherein the upper and lower apron belt guides cooperate to define a generally S-shaped path for said sliver from said inlet nipping area to the nip of said upper and lower outlet rollers, both of said apron belts lying substantially parallel to one another over at least the first curve of said S-shaped path following said nipping area, said sliver being guided thereafter by at least one apron belt.

12. A drafting apparatus in accordance with claim 11 wherein said lower guide has a convexly curved surface extending up to its nose region and forming a first portion of said S-shaped path around which said lower apron belt is guided and wherein said upper guide has a convexly curved surface extending up to its nose region defining a second part of said S-shaped path around which said upper apron belt passes, with said first and second parts of said S-shaped path merging into each other via a smooth tangential transition, and wherein said nose region of said upper apron belt extends furthest towards said nip formed between said upper and lower outlet rollers.

13. A drafting apparatus in accordance with claim 11 wherein said lower guide has a curved generally S-shaped guide surface for said lower apron belt, said S-shaped guide surface extending substantially up to said nose region of said lower guide and wherein said upper guide has a convexly curved guide surface extending up to its nose region, with said convexly curved guide surface of said upper apron belt guide being disposed adjacent to and conforming in shape to the curve of the S-shaped surface of said lower guide adjacent said upper and lower outlet rollers.

14. A drafting apparatus in accordance with claim 13 wherein said nose-shaped region of said upper apron belt guide extends in a smooth curve into said S-shaped guide surface of said lower apron belt guide and said fiber sliver lying on said lower apron belt is subjected to a further deflection around a top surface of said nose-shaped region of said lower guide immediately prior to entry into said nip between said inlet and outlet rollers.

15. A drafting apparatus in accordance with claim 11 wherein said fiber sliver is guided by continuously curved surfaces over substantially the full extent of its path from said nipping area to said nip.

16. A drafting apparatus in accordance with claim 12 wherein an angle $\alpha$ formed between a first tangent to the upper and lower inlet rollers in said nipping area and a tangent to said convexly curved surface of said lower guide at a transition of said fiber sliver from said convexly curved surface of said lower guide to said convexly curved surface of said upper guide lies in the range from 20° to 50°.

17. A drafting apparatus in accordance with claim 16 wherein said angle $\alpha$ amounts to 40°.

18. A drafting apparatus in accordance with claim 12 wherein an angle $\beta$ between a tangent to said convexly curved surface of said lower guide at a point of transition of said sliver from said convexly curved surface of said lower guide to said convexly curved surface of said upper guide and a tangent to said curved surface of said upper guide at a point of separation of said fiber sliver from said curved surface of said upper guide adjacent to said nip, lies in the range from 10° to 30°.

19. A drafting apparatus in accordance to claim 18 wherein said angle $\beta$ amounts to 20°.

20. A drafting apparatus in accordance with claim 12 wherein an angle $\gamma$ tangent to said convexly curved surface of said upper guide at a point of separation of said fiber sliver from said upper guide adjacent said nip and a tangent to said upper and lower outlet rollers at said nip, lies in the range from 5° to 15°.

21. A drafting apparatus in accordance to claim 20 wherein said angle $\gamma$ amounts to 10°.

22. A drafting apparatus in accordance with claim 13 wherein an angle $\delta$ between a tangent to said inlet and outlet rollers at said nipping area and a tangent to said S-shaped guide surface at a transition point where said sliver is guided around said convexly curved surface of said upper guide lies in the range from 15° to 40°.

23. A drafting apparatus in accordance with claim 22 wherein said angle $\delta$ amounts to 30°.

24. A drafting apparatus in accordance with claim 13 wherein an angle $\epsilon$ between a tangent to said S-shaped guide surface of said lower guide at a transition point where said sliver is guided around said convexly curved surface of said upper guide and a tangent to said curved surface of said upper guide at a point of separation of said fiber sliver therefrom adjacent to said nip of said upper and lower outlet roller pair lies in the range from 5° to 20°.

25. A drafting apparatus in accordance with claim 24 wherein said angle $\epsilon$ amounts to 15°.

26. A drafting apparatus in accordance with claim 13 wherein an angle $\xi$ between a tangent to said curved guide surface of said upper guide at a point of separation of said sliver from said curved surface of said upper guide adjacent to said nip of said upper and lower outlet rollers and a tangent to said S-shaped curved guide surface of said lower guide at said nose region at a point of separation of said sliver from said lower guide adjacent said nip lies in the range from 5° to 20°.

27. A drafting apparatus in accordance with claim 26 wherein said angle $\xi$ amounts to 15°.

28. A drafting apparatus in accordance with claim 12 wherein an angle $\pi$ between a tangent to said S-shaped guide surface of said lower guide at a point of separation of said sliver from said lower guide adjacent to said nip between said upper and lower outlet rollers at said nip lies in the range from 5° to 15°.

29. A drafting apparatus in accordance with claim 28 wherein and angle $\pi$ amounts to 10°.

30. A drafting apparatus in accordance with claim 12 wherein said convexly curved guide surface has a radius of curvature, at least at a central portion thereof, lying in the range from 15 to 50 mm.

31. A drafting apparatus in accordance with claim 30 wherein said radius amounts to 25 mm.

32. A drafting apparatus in accordance with claim 12 wherein said curved guide surface of said upper guide has a radius of curvature at a position where said sliver separates therefrom in the range from 2 to 5 mm.

33. A drafting apparatus in accordance with claim 32 wherein said radius amounts to 30 mm.

34. A drafting apparatus in accordance with claim 13 wherein said S-shaped guide surface of said lower guide has a radius of curvature over at least a portion of a first curve of said S at a position between said upper and lower inlet rollers and a point of transition to a second curved portion of said S-shaped guide surface in the range from 30 to 40 mm.

35. A drafting apparatus in accordance with claim 34 wherein said radius amounts to 20 mm.

36. A drafting apparatus in accordance with claim 13 wherein said convexly curved surface of said upper guide has a radius of curvature at a position confronting said S-shaped guide surface of said lower guide in the range from 2 to 5 mm.

37. A drafting apparatus in accordance with claim 34 wherein said radius amounts to 3 mm.

38. A drafting apparatus in accordance with claim 13 wherein said lower guide has a radius of curvature at said nose region at a point of separation of said sliver from said lower guide lying in the range from 2 to 5 mm.

39. A drafting apparatus in accordance with claim 38 wherein said radius amounts to 3 mm.

40. A drafting apparatus in accordance with claim 11 wherein resilient bias means is provided for resiliently biasing at least one of said upper and lower guides towards the other one of said upper and lower guides.

41. A drafting apparatus in accordance with claim 12 wherein said nose region of said upper guide is disposed sufficiently close to said upper and lower outlet rollers that said upper apron belt passing around said nose region is spaced from said upper and lower outlet rollers by a clearance of less than 2 mm.

42. A drafting apparatus in accordance with claim 13 wherein said nose region of said lower guide is disposed sufficiently close to said upper and lower outlet rollers that said lower apron belt passing around said nose region is spaced from said upper and lower outlet rollers by a clearance of less than 2 mm.

43. A drafting apparatus in accordance with claim 12 wherein a distance from a point at which said fiber sliver separates from said lower apron belt to said nip amounts to less than the staple length of fibers of said sliver.

44. A drafting apparatus in accordance with claim 43 wherein said distance amounts to less the 75% of said staple length.

45. A drafting apparatus in accordance with claim 13 wherein a distance from a point at which said sliver separates from said upper apron belt to said nip amounts to less than a stable length of said fibers.

46. A drafting apparatus in accordance with claim 45 wherein said distance amounts to less than 75% of said staple length.

47. A drafting apparatus having an apron zone for drafting a sliver in a yarn spinning machine comprising:

at least one apron drafting mechanism comprising a pair of upper and lower apron inlet rollers forming a rearward apron nipping area, an upper apron and a lower apron, a spring loaded upper apron cradle mechanism having a forward nose for engaging the upper apron, a guide having an upper surface and a forward nose for engaging the lower apron and a pair of upper and lower sliver delivery rollers;

the upper apron travelling around the upper inlet roller and around said forward nose of said cradle mechanism, and the lower apron traveling around the lower inlet roller and around said forward nose of said guide;

said spring loaded cradle mechanism urging the upper apron downwardly into pressing engagement with said lower apron, the pressingly engaged aprons forming a sliver path therebetween which is substantially S-shaped along a substantial length of the path between the inlet rollers and the delivery rollers.

48. A drafting apparatus having an apron zone for drafting a sliver in a yarn spinning machine comprising:

an apron drafting mechanism comprising a pair of upper and lower apron inlet rollers forming a first nipping area, an upper and a lower apron, an upper guide having a forward nose for engaging the upper apron, a lower guide having an upper surface and a forward nose for engaging the lower apron and a pair of upper and lower sliver delivery rollers forming a second nipping area;

the upper apron travelling around the upper inlet roller and the forward nose of the upper guide, and the lower apron travelling around the lower inlet roller, over the upper surface and around the forward nose of the lower guide;

the upper and lower aprons being resiliently pressed against each other such that a sliver may be delivered between the first and second nipping areas with the sliver sandwiched under the pressure between the aprons;

the upper and lower guides engaging the pressed together upper and lower aprons such that the sliver, during the course of travel between the first and second nipping areas, is substantially deflected in at least one upward direction out of the straight line path between the nipping areas and is also substantially deflected in at least one downward direction out of the straight line path between the nipping areas such that the sliver path between the first and second nipping areas is substantially S-shaped.

49. The drafting apparatus of claim 48 wherein the upper and lower guides engage the upper and lower aprons such that the sliver is deflected in a third direction out of the straight line path between the nipping areas during the course of travel of the sliver between the nipping areas.

50. The drafting apparatus of claim 49 wherein the sliver travels between the first and second nipping areas in a path which is at least partially S-shaped.

51. The drafting apparatus of claim 48 wherein the sliver travels between the first and second nipping areas in a path which is at least partially S-shaped.

* * * * *